US009536507B2

(12) United States Patent
Zhang et al.

(10) Patent No.: US 9,536,507 B2
(45) Date of Patent: Jan. 3, 2017

(54) ELECTRONIC DEVICE AND METHOD FOR PLAYING SYMPHONY

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Xue-Qin Zhang, Shenzhen (CN); Neng-De Xiang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/973,650

(22) Filed: Dec. 17, 2015

(65) Prior Publication Data

US 2016/0189697 A1 Jun. 30, 2016

(30) Foreign Application Priority Data

Dec. 30, 2014 (CN) ..... 2014 1 0853731

(51) Int. Cl.
*G10H 1/18* (2006.01)
*G10H 1/00* (2006.01)

(52) U.S. Cl.
CPC ..... *G10H 1/18* (2013.01); *G10H 1/0008* (2013.01); *G10H 2220/206* (2013.01); *G10H 2220/355* (2013.01); *G10H 2220/391* (2013.01); *G10H 2220/401* (2013.01); *G10H 2220/455* (2013.01); *G10H 2230/045* (2013.01)

(58) Field of Classification Search
USPC ..... 84/615, 653
IPC ..... G10H 1/18
See application file for complete search history.

(56) References Cited

U.S. PATENT DOCUMENTS 5,177,311 A * 1/1993 Suzuki ..... G10H 1/00 84/600
5,275,082 A * 1/1994 Kestner-Clifton ..... G10G 7/00 84/464 R
5,290,964 A * 3/1994 Hiyoshi ..... G06F 3/014 84/600
7,839,269 B2 * 11/2010 Steger ..... A63B 71/0686 340/407.1
8,093,995 B2 * 1/2012 Steger ..... A63B 71/0686 340/407.1
8,368,641 B2 * 2/2013 Tremblay ..... G06F 3/011 345/156
8,378,795 B2 * 2/2013 Steger ..... A63B 71/0686 340/407.1
8,586,853 B2 * 11/2013 Sakazaki ..... G10H 1/053 84/725

(Continued)

*Primary Examiner* — David Warren
(74) *Attorney, Agent, or Firm* — Zhigang Ma

(57) ABSTRACT

A symphony playing method using an electronic device includes calculating a distance value between a first GPS device of a first detecting device and a distal terminal of a baton. An angle between a first straight line and a second straight line is calculated. A capturing device is controlled to capture images of hand gestures of a user. Once a music instrument is determined to be currently pointed to by the distal terminal of the baton, according to the first distance value and the calculated angle, and a beat is determined according to the captured images, notes on the symphony is played using a tone of the determined music instrument according to the determined beat.

15 Claims, 4 Drawing Sheets

(56) References Cited

U.S. PATENT DOCUMENTS 9,018,510 B2 * 4/2015 Yoshihama ..... G10H 7/00 84/602
9,035,160 B2 * 5/2015 Rapp ..... G10H 3/125 84/104
2003/0196542 A1 * 10/2003 Harrison, Jr. ..... G04B 25/00 84/737
2006/0144212 A1 * 7/2006 Hofmeister ..... G10H 1/0083 84/724
2007/0000375 A1 * 1/2007 Harrison, Jr. ..... G04B 25/00 84/737
2009/0153350 A1 * 6/2009 Steger ..... A63B 71/0686 340/4.2
2011/0121954 A1 * 5/2011 Steger ..... A63B 71/0686 340/407.1
2012/0006181 A1 * 1/2012 Harada ..... G10H 1/0008 84/600
2012/0126960 A1 * 5/2012 Steger ..... A63B 71/0686 340/407.1
2012/0137858 A1 * 6/2012 Sakazaki ..... G10H 1/053 84/723
2012/0152087 A1 * 6/2012 Sakazaki ..... G10H 1/0008 84/600
2012/0216667 A1 * 8/2012 Sakazaki ..... G10H 3/14 84/725
2013/0047823 A1 * 2/2013 Tabata ..... G10H 1/0008 84/639
2013/0152768 A1 * 6/2013 Rapp ..... G10H 3/125 84/634
2013/0228062 A1 * 9/2013 Tabata ..... G10H 1/0008 84/602
2013/0239780 A1 * 9/2013 Tabata ..... G10H 1/0008 84/602
2013/0239781 A1 * 9/2013 Yoshihama ..... G10H 7/00 84/609
2013/0239782 A1 * 9/2013 Yoshihama ..... G10H 7/00 84/609
2013/0239783 A1 * 9/2013 Tabata ..... G10H 1/0008 84/609
2013/0239784 A1 * 9/2013 Tabata ..... G10H 1/0008 84/609
2013/0239785 A1 * 9/2013 Tabata ..... G10H 1/0008 84/609
2013/0255476 A1 * 10/2013 Sakurai ..... G10H 5/00 84/723
2013/0262021 A1 * 10/2013 Sakurai ..... G01B 21/16 702/141
2013/0262024 A1 * 10/2013 Sakurai ..... G01B 7/14 702/150
2015/0287395 A1 * 10/2015 Rapp ..... G10H 3/125 84/422.1
2016/0189697 A1 * 6/2016 Zhang ..... G10H 1/0008 84/609
2016/0203806 A1 * 7/2016 Hardi ..... G10D 13/003 84/600
2016/0203807 A1 * 7/2016 Hardi ..... G10D 13/003 84/600

* cited by examiner

ELECTRONIC DEVICE AND METHOD FOR PLAYING SYMPHONY

CROSS-REFERENCE TO RELATED APPLICATIONS

This application claims priority to Chinese Patent Application No. 201410853731.0 filed on Dec. 30, 2014, the contents of which are incorporated by reference herein.

FIELD

The subject matter herein generally relates to music playing technology, and particularly to an electronic device and a method for playing a symphony using the electronic device.

BACKGROUND

Generally, a symphony is played by a symphony orchestra that is conducted by a conductor. In other words, it is not available to enjoy the symphony only with the conductor when there is no symphony orchestra.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
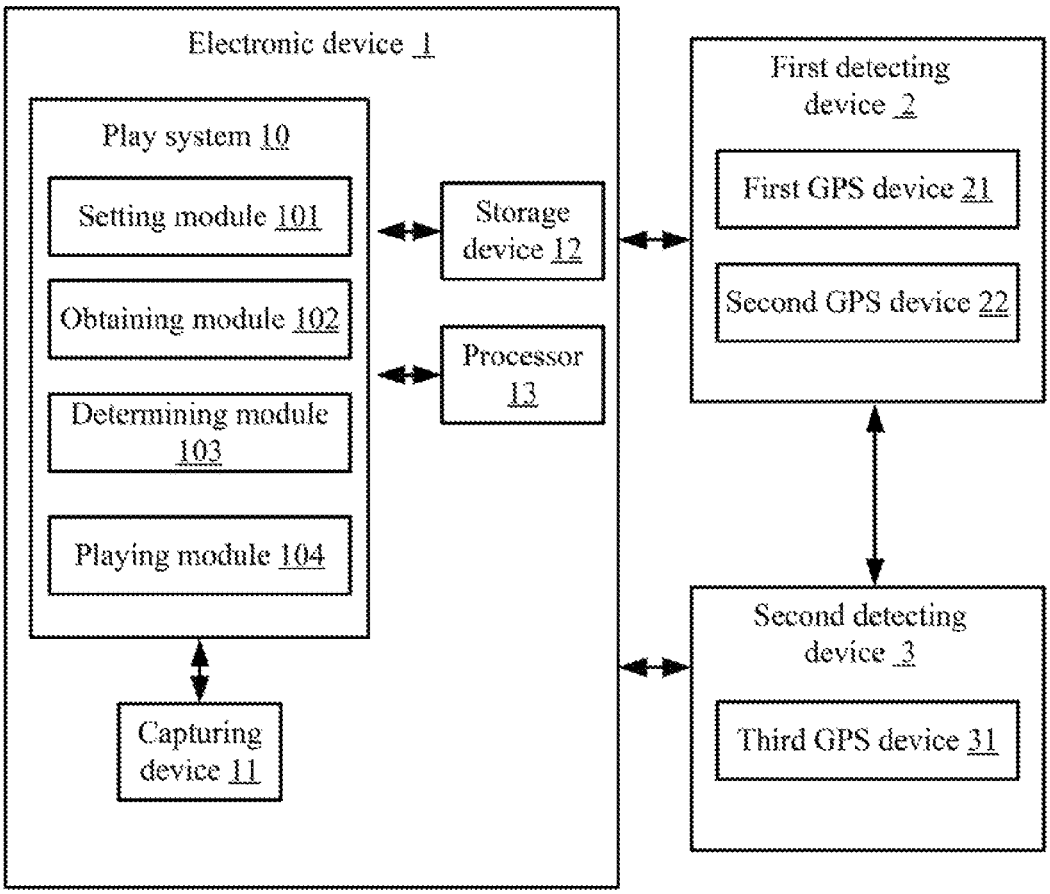
FIG. 1 is a block diagram of one embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The present disclosure, including the accompanying drawings, is illustrated by way of examples and not by way of limitation. It should be noted that references to "an" or "one" embodiment in this disclosure are not necessarily to the same embodiment, and such references mean "at least one."

Furthermore, the term "module", as used herein, refers to logic embodied in hardware or firmware, or to a collection of software instructions, written in a programming language, such as, Java, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media include CDs, DVDs, BLU-RAY, flash memory, and hard disk drives.

FIG. 1 is a block diagram of one embodiment of an electronic device. Depending on the embodiment, an electronic device 1 can be internally or externally connected with a capturing device 11. The electronic device 1 may include, but are not limited to, a playing system 10, a storage device 12 and at least one processor 13. The capturing device 1 can be an infrared capturing device. The electronic device 1 can be a mobile phone, a tablet personal computer, or any other suitable device. FIG. 1 illustrates only one example of the electronic device 1 that can include more or fewer components than illustrated, or have a different configuration of the various components in other embodiments.

Figure 2:
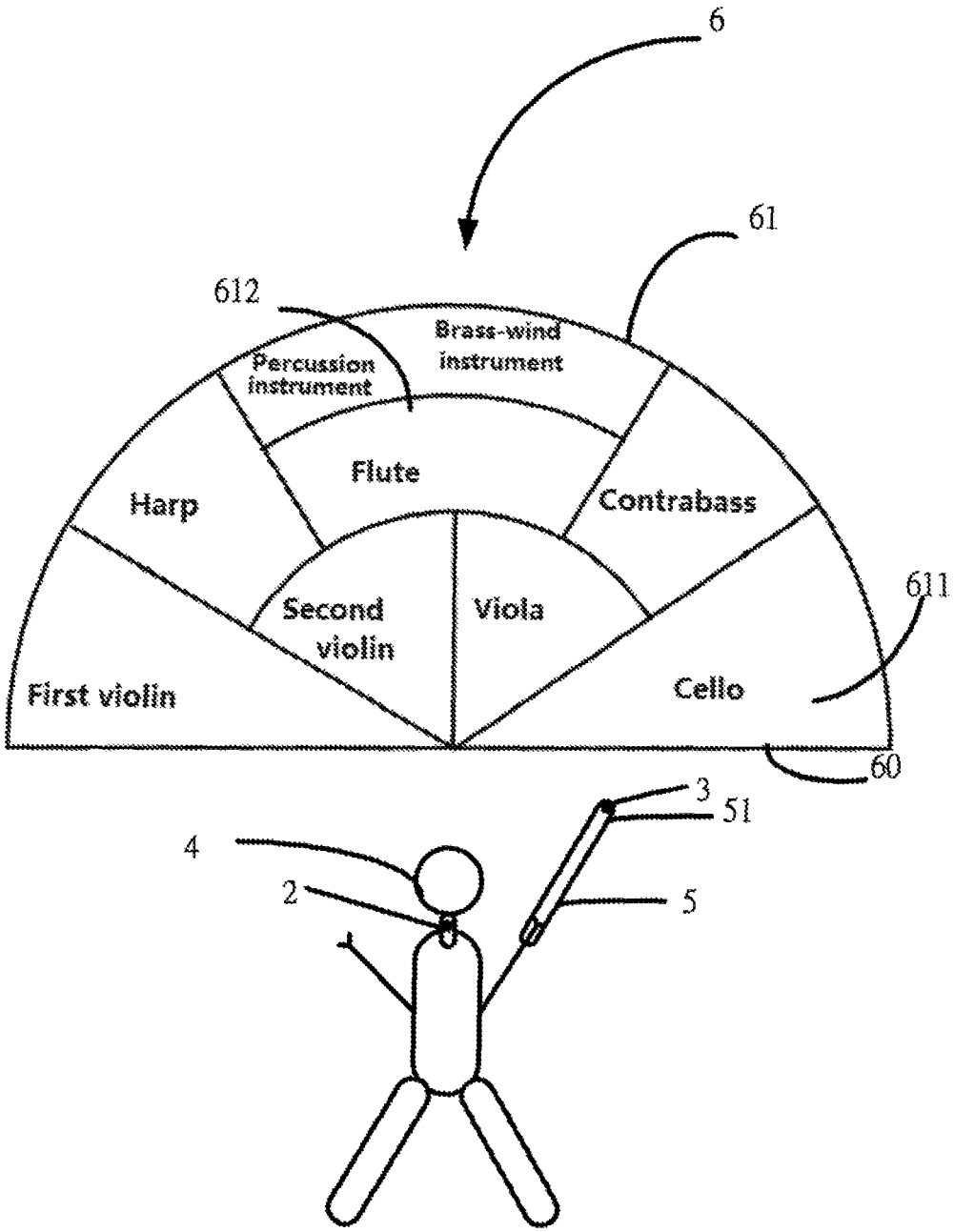
FIG. 2 illustrates one example of a mode of a symphony queue.

The playing system 10 can be used to play a predetermined symphony according to operations of a user 4. As shown in FIG. 2, the playing system 10 can determine a beat according to a gesture track of one hand of the user 4, which is not holding a baton 5. The playing system 10 can further determine a musical instrument of a symphony queue 6 that is currently pointed to by the baton 5 on another hand of the user 4. The playing system 10 can play notes on the predetermined symphony using a tone of the determined musical instrument according to the determined beat. In this embodiment, the symphony queue 6 is a virtual symphony orchestra. Details will be provided in following.

The storage device 12 can be an internal storage device, such as a flash memory, a random access memory (RAM) for temporary storage of information, and/or a read-only memory (ROM) for permanent storage of information. The storage device 12 can also be an external storage device, such as a smart media card, a secure digital card, and/or a flash card.

In one embodiment, the storage device 12 pre-stores at least one symphony. In one embodiment, the storage device 12 pre-stores tones of various kinds of musical instruments. In one embodiment, the various kinds of musical instruments may include, but are not limited to, a piano, a xylophone, an organ, a violin, a viola, a cello, a piccolo, a flute, and an oboe. The storage device 12 further pre-stores a plurality of modes of the symphony queue 6, music instruments corresponding to each mode of the symphony queue 6, and position of each of the musical instruments in each of the modes.

In one embodiment, the plurality of modes may include, but are not limited to, a mode of a European-style symphony queue, a mode of a western-style symphony queue. In one embodiment, the position of each of the musical instruments in each of the plurality of modes is pre-determined using a predetermined angle range and a predetermined radius range in a semicircle 61. The semicircle 61 is formed by the symphony queue 6.

For example, as shown in FIG. 2, the symphony queue 6 is arranged in the mode of the western-style symphony queue. A position of a cello 611 in the semicircle 61 can be pre-determined using an angle range (0, 30 degs], and a radius range [0, 1.5 metres]. A position of a flute 612 in the semicircle 61 can be pre-determined using an angle range (60, 120 degs], and a radius range [1, 1.25 metres]. Similarly, positions of other music instruments of the symphony queue 6 can also be similarly predetermined. The position of the cello 611, the position of the flute 612, and positions of other music instruments of the symphony queue 6 are pre-stored in the storage device 12.

The storage device 12 further pre-stores a plurality of gesture tracks corresponding to a plurality of beats. The plurality of beats may include, but are not limited to two-four, and three-four. Each of the plurality of gesture tracks corresponds to each of plurality of beats. Different beat corresponds to different gesture track. In one embodiment, each of the plurality of gesture tracks is recorded using an image.

The at least one processor 13 can be a central processing unit, a microprocessor, or any other chip with data processing function.

The display device 11 can provide an interface for interaction between a user and the electronic device 1. In one embodiment, the display device 11 is a touch screen.

Refer to FIG. 1 and FIG. 2, in one embodiment, the electronic device 1 can be in electronic connection with a first detecting device 2 and a second detecting device 3. The first detecting device 2 can be a wearable device having a triangle shape. In one embodiment, the first detecting device 2 can be wore on the neck of the user 4. In other embodiments, the first detecting device 2 can be sticked to the body of the user 4. The second detecting device 3 can be installed on a distal terminal 51 of the baton 5. In one embodiment, the distal terminal 51 can be defined as a second terminal of the baton 5 that is opposite to a first terminal of the baton 5, which is hold by the user 4. The first detecting device 2 can include, but are not limited to, a first GPS (Global Positioning System) device 21 and a second GPS device 22. The second detecting device 3 can include, but are not limited to, a third GPS device 31.

In one embodiment, the first detecting device 2 can control the first GPS device 21 to obtain first position data, and control the second GPS device 22 to obtain second position data at the same time. The first detecting device 2 can further send the first position data and the second position data to the electronic device 1 immediately the first position data and the second position data are obtained. The second detecting device 3 can control the third GPS device 31 to obtain third position data, and send the third position data to the electronic device 1 immediately the third position data is obtained.

In one embodiment, the first position data, the second position data, and the third position data are data of longitudes and latitudes. The electronic device 1 can calculate a first distance value between the first GPS device 21 and the third GPS device 31 using the first position data and the third position data. The electronic device 1 can further calculate a second distance value between the second GPS device 22 and the third GPS device 31 using the second position data and the third position data.

Figure 3:
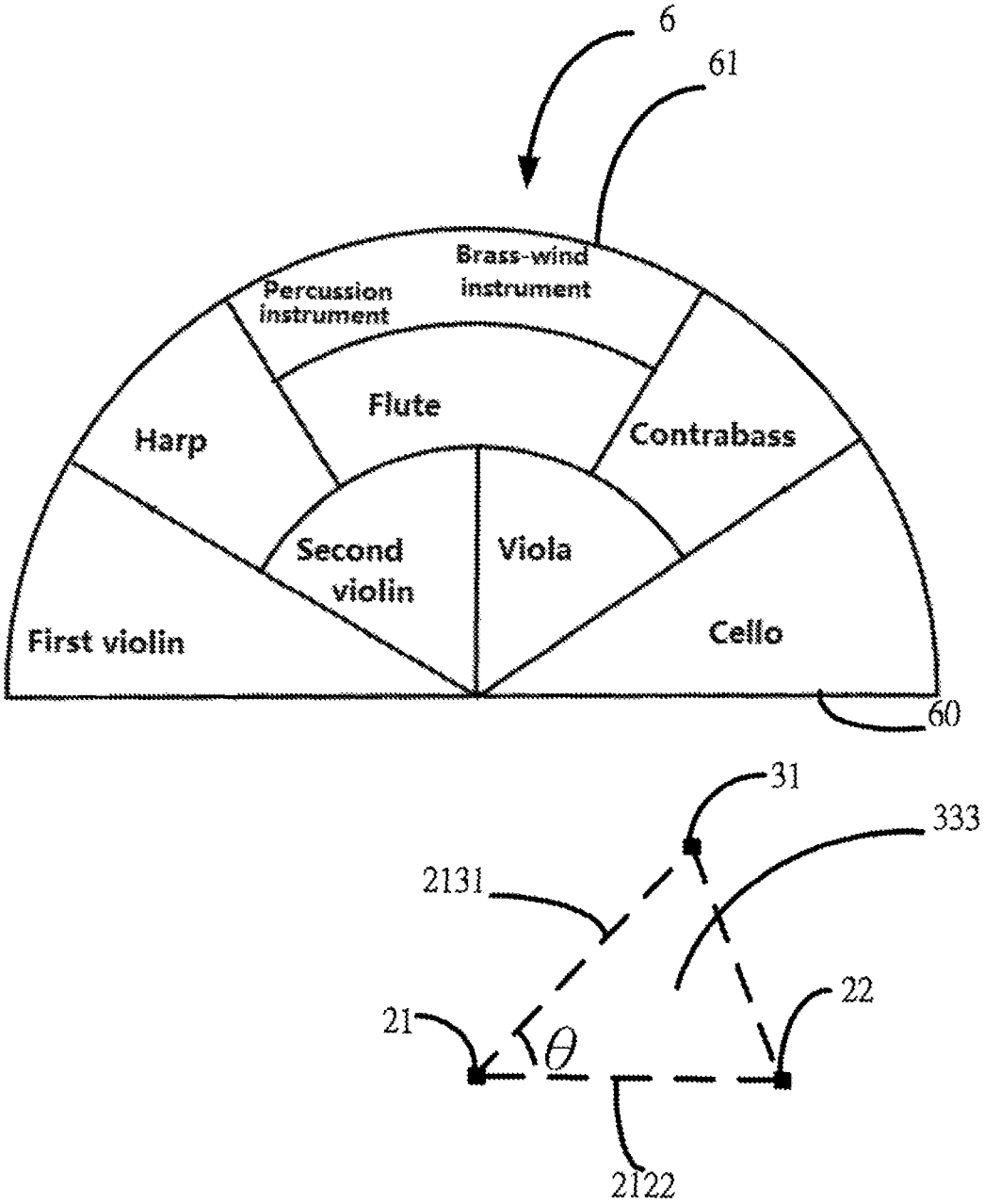
FIG. 3 illustrates one example of an angle between a distal terminal of a baton and a horizontal direction.

In one embodiment, a position of the first GPS device 21 and a position of the second GPS device 22 on the first detecting device 2 are configured specially. In one embodiment, the first GPS device 21 and the second GPS device 22 can be respectively installed at two endpoints of the wearable device having the triangle shape. As shown in FIG. 3, a distance value between the first GPS device 21 and the second GPS device 22 is equal to a predetermined value. In one embodiment, when the first detecting device 2 is wore on the user 4 or the first detecting device 2 is sticked to the body of the user 4, a first straight line 2122 formed based on the position of the first GPS device 21 and the position of the second GPS device 22 is parallel to a diameter 60 of the semicircle 61. The first GPS device 21 is substantially face to a center of the semicircle 61.

The reason for specially configuring the position of the first GPS device 21 and the position of the second GPS device 22 on the first detecting device 2 is because that when the distal terminal 51 of the baton 5 points to one music instrument in the semicircle 61, a triangle 333 can be formed by the third GPS device 31 that is configured on the distal terminal 51, the first GPS device 21 and the second GPS device 22. The playing system 10 can determine an angle "θ" in the triangle 333 as shown in the FIG. 3 to be one condition to determine which music instrument is currently pointed to by the distal terminal 51 of the baton 5. The angle "θ" is constituted by a second straight line 2131 and the first straight line 2122. The second straight line 2131 is formed based on the distal terminal 51 of the baton 5 and first GPS device 21.

It should be noted that when the first straight line 2122 is parallel to the diameter 60 of the semicircle 61, the angle "θ" constituted by the second straight line 2131 and the first straight line 2122 is equal to an angle between the first straight line 2122 and a right horizontal direction.

The playing system 10 can compare the angle "θ" with the predetermined angle range that is pre-stored in the storage device 12, to determine which music instrument is currently pointed to by the distal terminal 51 of the baton 5. Details will be provided in following.

In other embodiments, the first GPS device 21, the second GPS device 22, and the third GPS device 31 can be replaced with three wireless communication modules such as Wifi (Wireless Fidelity) modules or three RFID (Radio Frequency Identification) modules. For example, the first GPS device 21, the second GPS device 22, and the third GPS device 31 can be respectively replaced with a first wireless communication module, a second wireless communication module, and a third wireless communication module.

The playing system 10 can control the third wireless communication module to emit signals to the first wireless communication module and the second wireless communication module, and calculate the distance between the first wireless communication module and the third wireless communication module according to signal intensity of signals received by the first wireless communication module. The playing system can calculate a distance between the second wireless communication module and the third wireless communication module according to the signal intensity of signals received by the second wireless communication module.

In one embodiment, the playing system 10 can include one or more modules that are stored in the storage device 12, and are executed by the at least one processor 13. In at least one embodiment, the playing system 10 can include a setting module 101, an obtaining module 102, a determining module 103, and a playing module 104. The modules 101-104 can include computerized codes in a form of one or more programs, which are stored in the storage device 12, and are executed by the at least one processor 13. Details will be provided in conjunction with a flow chart of FIG. 4 in the following paragraphs.

Figure 4:
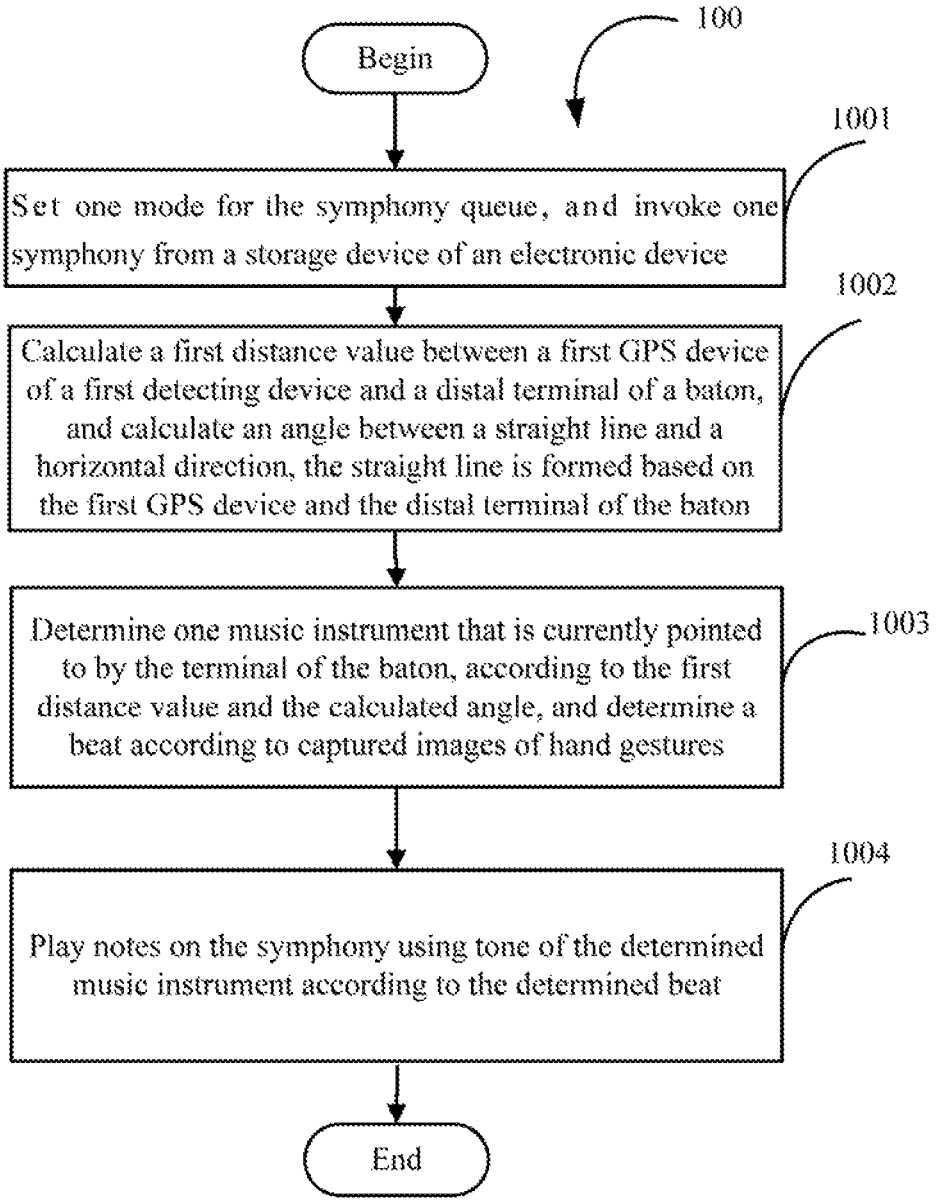
FIG. 4 illustrates a flowchart of one embodiment of a method for playing a symphony.

FIG. 4 illustrates a flowchart of one embodiment of a method of correcting a character. The example method 100 is provided by way of example, as there are a plurality of ways to carry out the method. The method 100 described below can be carried out using the configurations illustrated in FIG. 1, for example, and various elements of these figures are referenced in explaining example method 100. Each block shown in FIG. 4 represents one or more processes, methods or subroutines, carried out in the exemplary method 100. Additionally, the illustrated order of blocks is by example only and the order of the blocks can be changed according to the present disclosure. The exemplary method 100 can begin at block 1001. Depending on the embodiment, additional steps can be added, others removed, and the ordering of the steps can be changed.

At block 1001, the setting module 101 can set one mode for the symphony queue 6. The setting module 101 can further invoke one of the plurality of symphonies from the storage device 12.

In one embodiment, the setting module 101 can list the plurality of modes of the symphony queue 6 in a drop-down menu, then the setting module 101 can set the one mode according to user's selection from the drop-down menu.

At block 1002, when the user 4 uses the baton 5 to simulate a conductor conducting the symphony queue 6, the obtaining module 102 can calculate the first distance value between first GPS device 21 and the third GPS device 31. The obtaining module 102 can determine the first distance value is a distance value between the distal terminal 51 of the baton 5 and the first GPS device 21.

As mentioned above, the first detecting device 2 can control the first GPS device 21 to obtain first position data, and control the second GPS device 22 to obtain second position data. The first detecting device 2 can further send the first position data and the second position data to the electronic device 1 immediately the first position data and the second position data are obtained. The second detecting device 3 can control the third GPS device 31 to obtain third position data, and send the third position data to the electronic device 1 immediately the third position data is obtained.

Then the obtaining module 102 can receive the first position data, the second position data, and the third position data. As mentioned above, the first position data, the second position data, and the third position data can be data of longitudes and latitudes. Then the obtaining module 102 can calculate the first distance value between the first GPS device 21 and the third GPS device 31 using the first position data and the third position data.

The obtaining module 102 can further calculate an angle between the second straight line 2131 and a horizontal direction. In the embodiment, the angle between the second straight line 2131 and the horizontal direction can be defined to be an angle between the second straight line 2131 and the rightward horizontal direction. In other embodiments, the angle between the second straight line 2131 and the horizontal direction can also be defined to be an angle between the second straight line 2131 and a leftward horizontal direction.

As mentioned above, the angle "θ" in the triangle 333 as shown in the FIG. 3 is equal to the angle between the second straight line 2131 and the rightward horizontal direction. When the obtaining module 102 calculates the angel between the second straight line 2131 and the rightward horizontal direction, the obtaining module 102 can calculate the second distance value between the second GPS device 22 and the third GPS device 31 using the second position data and the third position data. The obtaining module 102 can further calculate the angle "θ" using the first distance value, the second distance value, and the predetermined distance value between the first GPS device 21 and the second GPS device 22, based on a cosine formula. That is, the angel between the second straight line 2131 and the rightward horizontal direction is obtained. It should be noted that the predetermined distance value is equal to a third distance value that can be calculated using the first position data and the second position data.

It should be noted that the angel between the second straight line 2131 and the leftward horizontal direction is equal to an angle that is obtained by subtracting the angle "θ" from 180 degrees.

The obtaining module 102 can further control the capturing device 11 to capture images of hand gestures of the user 4, when the user 4 simulates a conductor to conduct the symphony queue 6. When the user 4 simulates a conductor to conduct a symphony queue, the user 4 needs to use one hand to make hand gestures to indicate beats on the symphony, and use another hand to hold one terminal of a baton to conduct music instruments. The obtaining module 102 can control the capturing device 11 to capture images of the hand gestures.

At block 1003, the determining module 103 can determine one music instrument that is currently pointed to by the distal terminal 51 of the baton 5, according to the first distance value and the angle between the second straight line 2131 and the horizontal direction.

In one embodiment, the music instrument is determined by searching the storage device 12 using the first distance value and the angle between the second straight line 2131 and the horizontal direction. When the first distance value belongs to a predetermined radius range corresponding to a certain music instrument, and the angle between the second straight line 2131 and the horizontal direction belongs to a predetermined angle range corresponding to the certain music instrument, the determining module 103 determines the certain music instrument is the music instrument that is currently pointed to by the distal terminal 51 of the baton 5.

The determining module 103 can further determine a beat according to the captured images of hand gestures.

In one embodiment, the determining module 103 can determine a gesture track according to the captured images using image recognition technology. As mentioned above, the storage device 12 pre-stores a plurality of gesture tracks corresponding to a plurality of beats. Each of the plurality of gesture tracks corresponds to each of plurality of beats. That is, the determining module 103 can compare the determined gesture track with the pre-stored gesture tracks to determine the beat.

At block 1004, the playing module 104 can play notes on the symphony using the tone of the determined music instrument according to the determined beat. For example, when the flute 612 is the music instrument that is currently pointed to by the distal terminal 51 of the baton 50, the playing module 104 invokes the tone of the flute 612 from the storage device 12, and plays the notes on the symphony using the tone of the flute 612 according to the determined beat.

It should be emphasized that the above-described embodiments of the present disclosure, including any particular embodiments, are merely possible examples of implementations, set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. A method for playing a symphony using an electronic device, the method comprising:

calculating, at the electronic device, a first distance value between a first GPS device of a first detecting device and a distal terminal of a baton, wherein the first detecting device further comprises a second GPS device, a first straight line that formed between the first GPS device and the second GPS device is parallel to a horizontal direction, wherein a second detecting device comprises a third GPS device is positioned on the distal terminal;

calculating, at the electronic device, an angle between the first straight line and a second straight line that is formed based on the first GPS device and the distal terminal;

controlling, at the electronic device, a capturing device that is in electronic connection with the electronic device to capture images of hand gestures of a user;

determining, at the electronic device, one music instrument that is currently pointed to by the distal terminal of the baton, according to the first distance value and the calculated angle;

determining, at the electronic device, a beat according to the captured images; and playing, at the electronic device, notes on the symphony using a tone of the determined music instrument according to the determined beat.

2. The method according to claim 1, further comprising:

receiving first position data from the first GPS device;

receiving third position data from the third GPS device; and calculating the first distance value using the first position data and the third position data.

3. The method according to claim 2, further comprising:

receiving second position data from the second GPS device;

calculating a second distance value between the second GPS device and the third GPS device using the second position data and the third position data;

calculating a third distance value between the first GPS device and the second GPS device using the first position data and the second position data; and calculating the angle using the first distance value, the second distance value, and the third distance value based on a cosine formula.

4. The method according to claim 1, wherein the music instrument is determined by:

searching a storage device of the electronic device using the first distance value and the calculated angle, wherein the storage device pre-stores a position of each of music instruments of a symphony queue, the position is predetermined using a predetermined angle range and a predetermined radius range.

5. The method according to claim 1, wherein the beat is determined by:

determining a gesture track based on the captured images using image recognition technology; and comparing the determined gesture track with pre-stored gesture tracks to determine the beat, wherein a plurality of gesture tracks each corresponding to a beat are pre-stored in the electronic device.

6. An electronic device comprising:

at least one processor;

a storage device being configured to store one or more programs that, when executed by the at least one processor, cause the at least one processor to:

calculate a first distance value between a first GPS device of a first detecting device and a distal terminal of a baton, wherein the first detecting device further comprises a second GPS device, a first straight line that formed between the first GPS device and the second GPS device is parallel to a horizontal direction, wherein a second detecting device comprises a third GPS device is positioned on the distal terminal;

calculate an angle between the first straight line and a second straight line that is formed based on the first GPS device and the distal terminal;

control a capturing device that is in electronic connection with the electronic device to capture images of hand gestures of a user;

determine one music instrument that is currently pointed to by the distal terminal of the baton, according to the first distance value and the calculated angle;

determine a beat according to the captured images; and play notes on the symphony using a tone of the determined music instrument according to the determined beat.

7. The electronic device according to claim 6, the at least one processor further caused to:

receive first position data from the first GPS device;

receive third position data from the third GPS device; and calculate the first distance value using the first position data and the third position data.

8. The electronic device according to claim 7, wherein the calculated angle is obtained by:

receiving second position data from the second GPS device;

calculating a second distance value between the second GPS device and the third GPS device using the second position data and the third position data;

calculating a third distance value between the first GPS device and the second GPS device using the first position data and the second position data; and calculating the angle using the first distance value, the second distance value, and the third distance value based on a cosine formula.

9. The electronic device according to claim 6, wherein the music instrument is determined by:

searching a storage device of the electronic device using the first distance value and the calculated angle, wherein the storage device pre-stores a position of each of music instruments of a symphony queue, the position is predetermined using a predetermined angle range and a predetermined radius range.

10. The electronic device according to claim 6, wherein the beat is determined by:

determining a gesture track based on the captured images using image recognition technology; and comparing the determined gesture track with pre-stored gesture tracks to determine the beat, wherein a plurality of gesture tracks each corresponding to a beat are pre-stored in the electronic device.

11. A non-transitory storage medium having stored thereon instructions that, when executed by a processor of an electronic device, causes the processor to perform a method of playing a symphony, wherein the method comprises:

calculating a first distance value between a first GPS device of a first detecting device and a distal terminal of a baton, wherein the first detecting device further comprises a second GPS device, a first straight line that formed between the first GPS device and the second GPS device is parallel to a horizontal direction, wherein a second detecting device comprises a third GPS device is positioned on the distal terminal;

calculating an angle between the first straight line and a second straight line that is formed based on the first GPS device and the distal terminal;

controlling a capturing device that is in electronic connection with the electronic device to capture images of hand gestures of a user;

determining one music instrument that is currently pointed to by the distal terminal of the baton, according to the first distance value and the calculated angle;

determining a beat according to the captured images; and playing notes on the symphony using a tone of the determined music instrument according to the determined beat.

12. The non-transitory storage medium according to claim 11, further comprising:

receiving first position data from the first GPS device;

receiving third position data from the third GPS device; and calculating the first distance value using the first position data and the third position data.

13. The non-transitory storage medium according to claim 12, wherein the calculated angle is obtained by:

receiving second position data from the second GPS device;

calculating a second distance value between the second GPS device and the third GPS device using the second position data and the third position data;

calculating a third distance value between the first GPS device and the second GPS device using the first position data and the second position data; and calculating the angle using the first distance value, the second distance value, and the third distance value based on a cosine formula.

14. The non-transitory storage medium according to claim 11, wherein the music instrument is determined by:

searching a storage device of the electronic device using the first distance value and the calculated angle, wherein the storage device pre-stores a position of each of music instruments of a symphony queue, the position is predetermined using a predetermined angle range and a predetermined radius range.

15. The non-transitory storage medium according to claim 11, wherein the beat is determined by:

determining a gesture track based on the captured images using image recognition technology; and comparing the determined gesture track with pre-stored gesture tracks to determine the beat, wherein a plurality of gesture tracks each corresponding to a beat are pre-stored in the electronic device.

* * * * *